US008180632B2

(12) United States Patent
Kovesi et al.

(10) Patent No.: US 8,180,632 B2
(45) Date of Patent: May 15, 2012

(54) METHOD FOR LIMITING ADAPTIVE EXCITATION GAIN IN AN AUDIO DECODER

(75) Inventors: Balazs Kovesi, Lannion (FR); David Virette, Pleumeur-Bodou (FR)

(73) Assignee: France Telecom, Paris (FR)

( * ) Notice: Subject to any disclaimer, the term of this patent is extended or adjusted under 35 U.S.C. 154(b) by 730 days.

(21) Appl. No.: 12/224,566

(22) PCT Filed: Feb. 13, 2007

(86) PCT No.: PCT/FR2007/050779

§ 371 (c)(1),
(2), (4) Date: Mar. 16, 2009

(87) PCT Pub. No.: WO2007/099244

PCT Pub. Date: Sep. 7, 2007

(65) Prior Publication Data

US 2009/0204412 A1 Aug. 13, 2009

(30) Foreign Application Priority Data

Feb. 28, 2006 (FR) ..... 06 50688

(51) Int. Cl.
*G10L 19/00* (2006.01)
*G10L 19/02* (2006.01)

(52) U.S. Cl. ..... 704/219; 704/228; 704/501

(58) Field of Classification Search ..... None
See application file for complete search history.

(56) References Cited

U.S. PATENT DOCUMENTS

| | | | | |
|---|---|---|---|---|
| 5,623,575 | A * | 4/1997 | Fette et al. | 704/265 |
| 5,708,757 | A | 1/1998 | Massaloux | |
| 5,960,386 | A | 9/1999 | Janiszewski et al. | |
| 5,987,406 | A | 11/1999 | Honkanen | |
| 6,574,593 | B1 * | 6/2003 | Gao et al. | 704/222 |
| 7,499,853 | B2 * | 3/2009 | Yoshida et al. | 704/219 |
| 7,636,055 | B2 * | 12/2009 | Yamanashi et al. | 341/50 |
| 2009/0276212 | A1 * | 11/2009 | Khalil et al. | 704/226 |

FOREIGN PATENT DOCUMENTS

EP 1 207 519 5/2002

OTHER PUBLICATIONS

Salami et al., "Design and Description of CS-ACELP: A Toll Quality 8 kb/s Speech Coder", IEEE Transactions on Speech and Audio Processing, vol. 6, No. 2, Mar. 1998.*

* cited by examiner

*Primary Examiner* — Brian Albertalli
(74) *Attorney, Agent, or Firm* — Cozen O'Connor

(57) ABSTRACT

Decoder for an audio signal coded by a coder including a long-term prediction filter wherein the decoder comprises: a block (211) for detecting transmission frame losses; a module (222) for calculating values of an error indication function representative of the cumulative adaptive excitation error during decoding following said transmission frame loss, an arbitrary value being assigned to said adaptive excitation gain for the lost frame; a module (213) for calculating an error indication parameter from said values of the error indication function; a comparator (214) for comparing said error indication parameter to at least one given threshold; and a discriminator (215) adapted to determine as a function of the results supplied by the comparator (214) a value of at least one adaptive excitation gain to be used by the decoder.

13 Claims, 5 Drawing Sheets

FIG. 2 (Prior art)

| Type | Parameters | Symbol |
|---|---|---|
| Filter | Coefficients (coded in LSF domain) | $1/\hat{A}(z)$ |
| Excitation | Pitch period | P, P_frac |
| | Pitch and code gains | $g_c$, $g_p$ |
| | ACELP dictionaries (4 pulses ±1) | Code |

METHOD FOR LIMITING ADAPTIVE EXCITATION GAIN IN AN AUDIO DECODER

RELATED APPLICATIONS

This is a U.S. national stage under 35 USC 371 of application No. PCT/FR2007/050779, filed on Feb. 13, 2007.

This application claims the priority of French patent application No. 06/50688 filed Feb. 28, 2007, the content of which is hereby incorporated by reference.

FIELD OF THE INVENTION

The present invention relates to a method of limiting adaptive excitation gain in an audio decoder. It also relates to a decoder for decoding an audio signal that has been coded by a coder including a long-term prediction filter.

The invention finds an advantageous application in the field of coding and decoding digital signals, such as audio-frequency signals.

The invention is particularly suitable for transmission, for example voice over IP transmission, of speech and/or audio signals in packet-switched networks, to provide acceptable quality on decoding after loss of packets and in particular to avoid saturation of long-term prediction (LTP) filters used for decoding in a code excited linear prediction (CELP) coding context.

BACKGROUND OF THE INVENTION

One example of a CELP coder is the system covered by ITU-T Recommendation G.729, which is designed for speech signals in the telephone band from 300 hertz (Hz) to 3400 Hz sampled at 8 kHz and transmitted at a fixed bit rate of 8 kilo bits per second (kbps) using 10 millisecond (ms) frames. The operation of this coder is described in detail in the paper by R. Salami, C. Laflamme, J. P. Adoul, A. Kataoka, S. Hayashi, T. Moriya, C. Lamblin, D. Massaloux, S. Proust, P. Kroon and Y. Shoham, "Design and description of CS-ACELP: a toll quality 8 kbps speech coder", IEEE Trans. on Speech and Audio Processing, Vol. 6-2, March 1998, pp. 116-130.

FIG. 1(*a*) is a high-level view of a G.729 coder. This figure shows high-pass preprocessing filtering 101 for eliminating signals at frequencies below 50 Hz. The filtered speech signal S(n) is then analyzed by the block 102 to determine a linear prediction coding (LPC) filter $\hat{A}(z)$ that is sent to the multiplexer 104 in the form of an index that indexes the quantized vector (QV) in a dictionary.

The original signal S(n) filtered by the filter $\hat{A}(z)$, which is referred to as the excitation signal, is processed by the block 103 to extract from it the parameters listed in the table in FIG. 2. Those parameters are then coded and sent the multiplexer MUX 104.

FIG. 1(*b*) shows in detail the operation of the excitation coding block 103. As can be seen in the figure, the excitation signal is coded in three steps:

- in a first step, long-term prediction (LTP) filtering is effected by the blocks 106, 107, 111; the LTP filter of the G.729 coder is a first order filter; the adaptive excitation period P, which is also known as the "pitch" period, expressed as an integer value $P_0$ and where appropriate complemented by a fractional value $P_{0_}$ fractional, and the adaptive excitation gain $g_p$, also known as the "pitch" gain, are determined by analysis by synthesis to minimize the error between the target excitation signal from the block 105 and the synthesized signal given by $x(n)=g_p \cdot x(n-P)$, n representing a sample of the signal;
- then, in a second step, the residual difference between these two signals is modeled, firstly, by a fixed code c(n), also known as an innovator code, extracted from an ACELP innovator dictionary 108 with 4 pulses ±1, and, secondly, by a fixed excitation gain $g_c$ 109; the fixed code c(n) and the gain $g_c$ are determined by minimizing at 111' the error between the residual signal from the preceding LTP stage and the signal $g_c \cdot c(n)$;
- finally in a final step, the resulting parameters, namely the pitch period P, the fixed code c(n), the pitch gain $g_p$, and the fixed excitation gain $g_c$, are coded and sent to the multiplexer 104.

FIG. 1(*c*) shows how a standard G.729 decoder reconstructs the speech signal from data received by the demultiplexer 112 from the multiplexer 104. The excitation signal is reconstituted in the form of 5 ms sub-frames by adding two contributions:

- a first contribution that results from decoding (115) the pitch period P and decoding (118) the pitch gain $g_p$ to reconstitute at the output of the blocks 116, 117 the adaptive excitation LTP signal $x(n)=g_p \cdot x(n-P)$;
- a second contribution that results from decoding (113) the fixed excitation signal c(n) scaled by the gain $g_p$ decoded by the block 118 to reconstitute the fixed excitation signal $g_c \cdot c(n)$;
- these two contributions are then added to give the decoded excitation signal $x(n)=g_p \cdot x(n-P)+g_c \cdot c(n)$.

The decoded excitation signal is shaped by an LPC synthesis filter 120, the coefficients of which are decoded by the block 119 in the LSF (line spectral frequency) domain, and interpolated at the 5 ms sub-frame level. To improve quality and to conceal certain coding artifacts, the reconstructed signal is then processed by an adaptive post-filter 121 and by a high-pass post-processing filter 122. The FIG. 1(*c*) decoder therefore relies on the source-filter model to synthesize the signal.

With the excitation signal coming from the long-term prediction (LTP) filter, and with the aim of generating an excitation signal capable of rapidly tracking the attack of the signal, CELP coders generally authorize the choice of a pitch gain $g_p$ greater than 1. Consequently, the decoder is locally unstable. However, this instability is controlled by the analysis by synthesis model, which continuously minimizes the difference between the excitation signal LTP and the original target signal.

In the event of transmission errors or loss of frames, such instability can lead to serious deterioration caused by the offset between the coder and the decoder. Under these circumstances, a pitch gain value $g_p$ that is not received in a frame is generally replaced by the value $g_p$ in the preceding frame, and although the variable nature of the speech signal consisting of alternating voiced periods with a pitch gain close to 1 and non-voiced periods with a pitch gain less than 1 generally limits potential problems linked to this local instability, it nevertheless remains true that, for some signals, in particular voiced signals, transmission errors in periodic stationary areas can cause serious deterioration if, for example, the replacement gain $g_p$ is higher than the real gain and the frame concerned is followed by high-gain frames, as occurs during the attack of a signal. This situation then leads quickly to saturation of the LTP filter by a cumulative effect linked to the recursive character of long-term predictive filtering.

A first solution to this problem is to limit the pitch $g_p$ to 1, but this constraint has the effect of degrading the performance of the CELP coders during the attack of a signal.

Other solutions propose to limit the pitch gain $g_p$ to a value less than or equal to 1 only if this is deemed necessary. In particular:

The method described in U.S. Pat. No. 5,960,386 can be divided into a number of stages executed in the coder. First of all, there is a procedure for detecting possible instability using the pitch gain previously calculated and an average of preceding pitch gains. If there is no risk of instability, the pitch gain previously calculated is retained. Otherwise, an iterative pitch gain control procedure adapts this gain to eliminate the risk of instability.

A procedure for detecting instabilities in the coder is described U.S. Pat. Nos. 5,893,060 and 5,987,406. It uses LSP parameters to determine the presence of resonance in the spectrum, calculates the duration of the resonance, expressed as a number of frames, and evaluates the possibility of instability as a function of the pitch gain value. If instability is detected, the value of the pitch gain is saturated at a threshold and the search for the gain vector in the vectorial quantizing of the pitch gains is modified so that the vector chosen has a pitch gain value below the threshold.

The above-mentioned paper by R. Salami and U.S. Pat. No. 5,708,757 describe a procedure for detecting possible saturation or for calculating the associated pitch gain value present in the standard G.729 coder. This method, known as "taming", takes into account the maximum potential error of the decoder in the excitation calculation. If this error exceeds a certain threshold when the pitch gain is greater than 1, corresponding to an unstable filter, the gain is modified to take a value less than 1 in order to stabilize the filter. The idea is therefore to detect, in the coder, areas in which the accumulation of preceding transmission errors can cause saturation of the long-term filter that is locally unstable, in particular during long strongly-voiced passages. These passages are detected by examining the output of a second long-term filter with constant excitation that simulates the maximum potential error. An identical technique is referred to in ITU-T Recommendation G.723.1, where the coder uses a fifth long-term predictor for which the pitch gain is a vector of 5 coefficients applied to 5 consecutive samples from the past. These gain vectors can be quantized by vectorial quantization. Although the stability of a first order long-term filter, like that of the G.729 coder, is very easy to verify by comparing the single-gain coefficient with the value 1, this verification is much more complicated for a higher order long-term filter. The stability of a long-term filter using a gain set also depends on the nature of the signal, for example the pitch. Thus the same gain set can be stable in one situation but unstable in another. This makes it difficult to estimate error propagation, because the nature of the potential error may not be known to the coder, and it is not a simple matter to detect potentially unstable areas or to determine the attenuation to be applied to re-stabilize the filter. The solution implemented in Recommendation G.723.1 is to find for each possible gain vector of the coder an equivalent average first order gain through a learning process. These values are stored in a table. This equivalent first order filter is therefore used to estimate the maximum potential cumulative error in the long-term filter and thereby to identify unstable areas in which the gain must be limited in the event of a high cumulative error and the gain to be applied to stabilize the filter must be calculated.

However, the solutions proposed by these known techniques to avoid the risk of saturation of the LTP filters in the presence of losses or transmission errors cause the following problems:

The decision to modify the gain $g_p$ associated with long-term prediction being made in the coder a priori, it is not possible, after frames have been lost, to control completely the state of the decoder and its behavior, which by hypothesis are unknown to the coder. Also, the existing techniques can continue to cause audio deterioration on decoding in the event of transmission errors despite the decision taken by the coder to modify the gain.

The limitation to 1 of the pitch gain $g_p$ associated with the techniques described above can lead to slight deterioration of quality, for example in attack phases, which normally generate gains greater than 1. The triggering threshold chosen is a compromise between quality and security. A low threshold would trigger limitation too often, causing unnecessary deterioration, especially in the absence of transmission errors. Conversely, a higher threshold would not guarantee sufficient protection in the event of high error rates.

SUMMARY OF THE INVENTION

One object of the present invention is to provide a method of limiting adaptive excitation gain in a decoder when decoding an audio signal coded by a coder including a long-term predictive filter, following loss of frames between said coder and said decoder, which method would limit the adaptive excitation gain, or pitch gain $g_p$, only if instability of the LTP filter is actually found, and arrive at the best possible compromise between decoding quality and robustness in the face of frame loss.

This and other objects are attained in accordance with one aspect of the present invention in which the method comprises, in the decoder, the steps of:

establishing an error indication function intended to supply values representative of the accumulated error to adaptive excitation decoding after said transmission frame loss, an arbitrary value being assigned to said adaptive excitation gain for the lost frame;

calculating values of said error indication function during decoding;

calculating an error indication parameter from said values of the error indication function;

comparing said error indication parameter to at least one given threshold; and applying a limitation to at least one adaptive excitation gain in the event of positive comparison if a gain equivalent to at least one adaptive excitation gain is higher than a given value.

Here "frame loss" generally refers to non-reception of a frame and to transmission errors in a frame.

In one implementation, said arbitrary value is equal to a value of the adaptive excitation gain determined during said lost frame by an error dissimulation algorithm.

By way of example of an error dissimilation algorithm, said arbitrary value is equal to the value of the adaptive excitation gain for the frame that was not lost preceding the frame that has been lost.

In another example, said arbitrary value is defined on the basis of detecting voicing of the preceding frame. For a voiced frame, said arbitrary value is equal to 1; otherwise the arbitrary value is equal to 0, and the excitation signal consists of random noise.

As emerges in more detail below, the method of the invention has the advantage that it does not modify the pitch gain $g_p$ unless the possibility of instability of the LTP filter is detected in the decoder itself, and not in the coder, as in the prior art techniques. Moreover, the method of the invention takes into account the real state of the decoder and exact information on any transmission errors that have occurred.

The method of the invention can be used autonomously, i.e. in coding structures that do not provide for limitation of the pitch gain in the coder.

However, in one embodiment of the invention, the adaptive excitation gain is supplied to said decoder by a coder equipped with a gain limiter device. An embodiment of the method of the invention can also be used in combination with a known a priori "taming" technique installed in the coder. The advantages of the two techniques are therefore cumulative: the a priori technique limits unduly-long sequences of pitch gains greater than 1. This is because such sequences lead to serious error propagation, constraining the method of the invention to modify the signal over long periods. However, an unduly low threshold for triggering the a priori "taming" technique degrades the signal. The invention reduces the number of times the a priori "taming" technique is triggered by raising the threshold, because although this a priori technique does not detect the risk of explosion, the a posteriori method of the invention detects and remedies it.

In a particular implementation of the invention, said error indication function is of the form:

$$x_t(n) = e_t(n) + \sum_i g_{it} \cdot x_t(n - P + i) \quad i \in [-(N-1)/2, (N-1)/2]$$

where:

- N is the order of the long-term prediction filter, usually uneven number;
- the gains $g_{it}$ are equal to the adaptive excitation gains of said adaptive long-term filter for received frames or to the adaptive excitation gains of said long—term prediction filter in the preceding frame for lost frames;
- $e_t(n)$ has the value 0 for received frames and the value 1 for lost frames;
- P is the adaptive excitation period.

Of course, in the simplest situation, the order N of the LTP filter can be taken as equal to 1.

In a first implementation of the method of the invention, the adaptive excitation gain $g_p$ of a first order long-term predictive filter is limited to the value 1 if said error indication parameter is above said given threshold.

Similarly, the invention teaches that a correction factor is applied to the adaptive excitation gains $g_i$ of a long-term predictive filter of order higher than 1 if said error indication parameter is above said given threshold.

In a second implementation, said at least one adaptive excitation gain is limited by a linear function of said given threshold if said error indication parameter is above said threshold. This advantageous arrangement makes gain limitation more progressive and avoids a sharp threshold effect.

An aspect of the invention relates to a program including instructions stored on a computer-readable medium for executing the steps of the method of the invention when said program is executed in a computer.

An aspect of the invention relates to a decoder for an audio signal coded by a coder including a long-term prediction filter, noteworthy in that said decoder includes:

- a block for detecting transmission frame losses;
- a module for calculating values of an error indication function representative of the cumulative adaptive excitation error during decoding following said transmission frame loss, an arbitrary value being assigned to said adaptive excitation gain for the lost frame;
- a module for calculating an error indication parameter from said values of the error indication function;
- a comparator for comparing said error indication parameter to at least one given threshold; and
- a discriminator adapted to determine as a function of the results supplied by the comparator a value of at least one adaptive excitation gain to be used by the decoder.

BRIEF DESCRIPTION OF THE DRAWINGS

The following description with reference to the appended drawings, which are provided by way of non-limiting example, explains clearly in what the invention consists and how it can be reduced to practice.

FIG. 1(*b*) is a detailed diagram of an excitation coding block of the FIG. 1(*a*) coder.

FIG. 1(*c*) is a diagram of the decoder associated with the coder from FIG. 1(*a*).

FIG. 2 is a table setting out the coding parameters of the coder from FIG. 1(*a*).

DETAILED DESCRIPTION OF THE DRAWINGS

The invention is described in detail below in the context of a G.729 decoder and long-term prediction (LTP) filtering of order N=1. LTP filtering of any order N is covered at the end of this description.

Figure 1A:
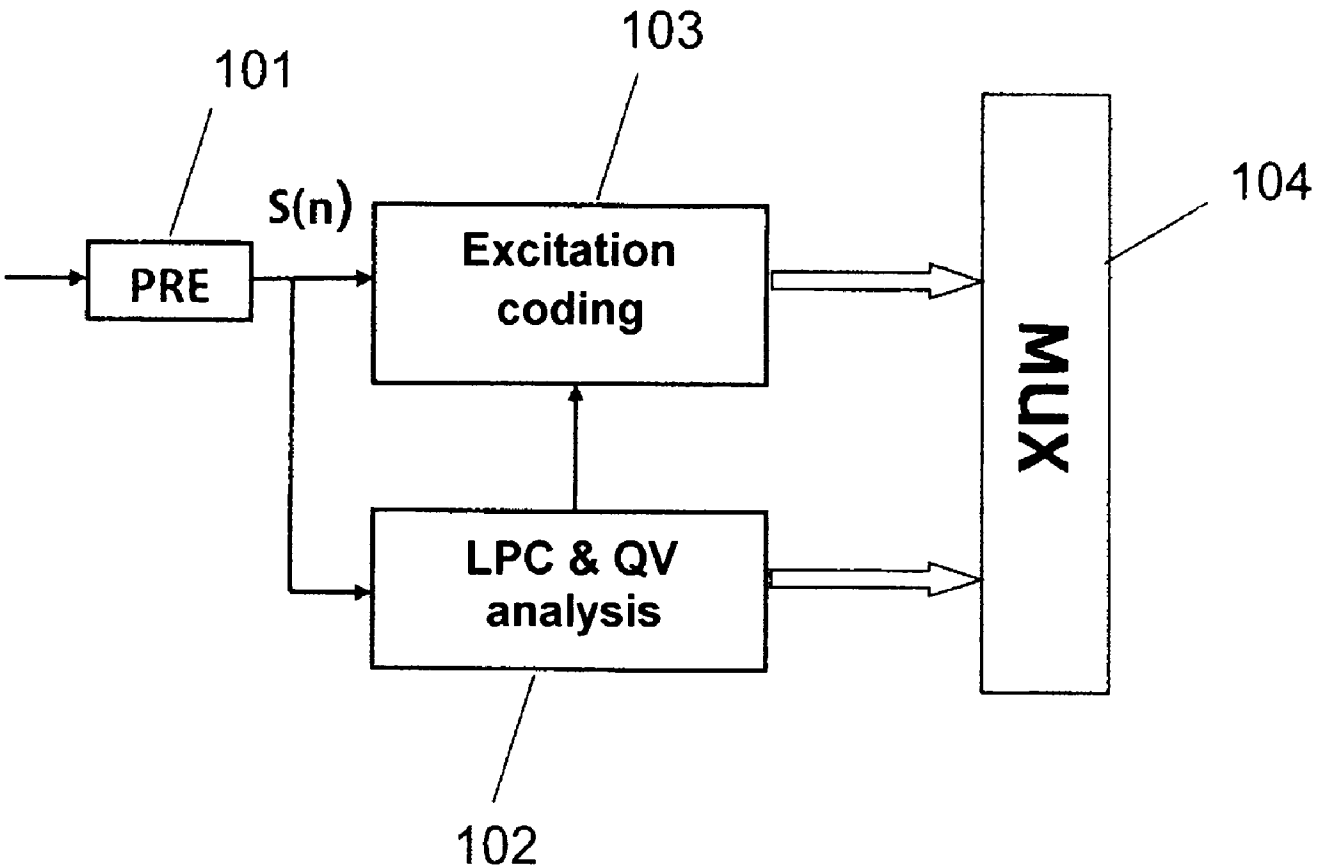
FIG. 1(a) (Prior art)
FIG. 1(*a*) is a high-level diagram of a G.729 coder.
Figure 1B:
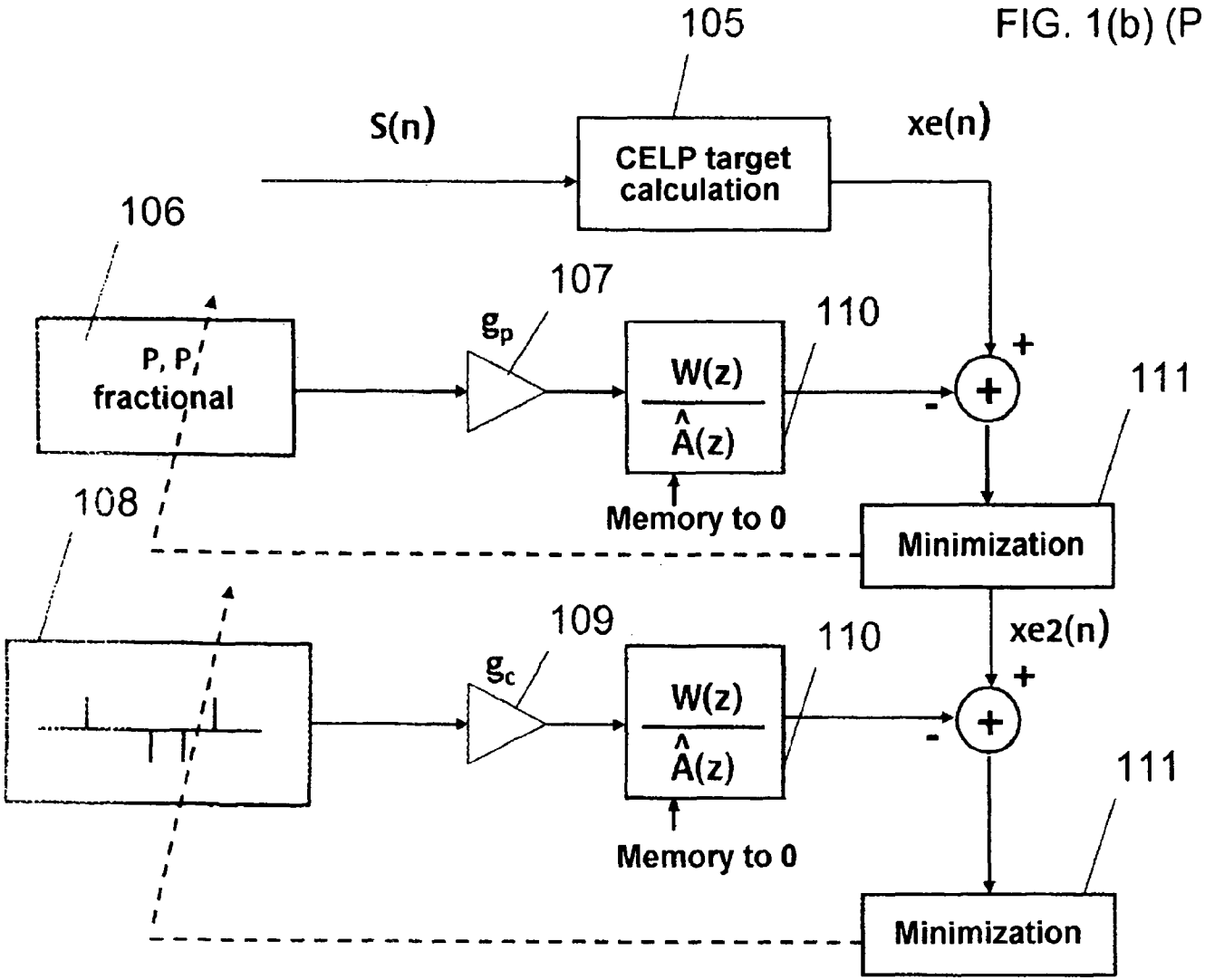
FIG. 1(b) (Prior art)
Figure 1C:
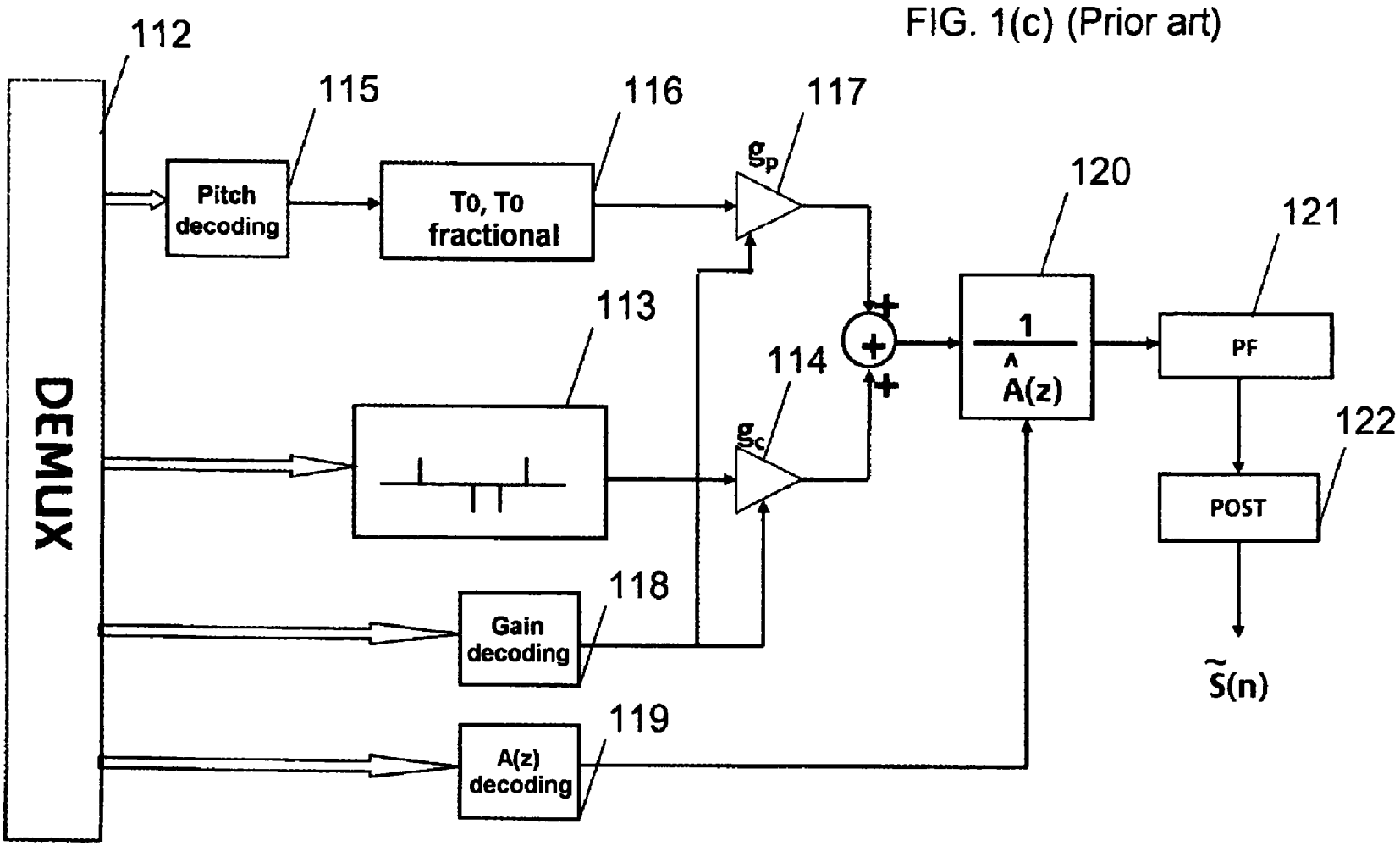
FIG. 1(c) (Prior art)

The excitation signal $x_e(n)$ coming from the excitation coding block 103 of FIG. 1(*a*) and shown in FIG. 1(*b*) is the sum of the adaptive excitation signal $g_p \cdot x_e(n-P)$ and the fixed excitation signal $g_c \cdot c(n)$:

$$x_e(n) = g_p \cdot x_e(n-P) + g_c \cdot c(n)$$

where:

- $g_p$ is the adaptive excitation gain or pitch gain;
- P is the value of the pitch or period length; the G.729 coder uses fractional resolution by steps of ⅓for long pitch values (P<85) for better modeling of high-pitched voiced sounds; adaptive excitation with a fractional pitch is obtained by interpolation and oversampling;
- $g_c$ is the fixed excitation gain;
- c(n) is the fixed or innovator code word.

Adaptive excitation depends only on the past excitation and efficiently models periodic signals, especially voiced signals, where the excitation itself is repeated virtually periodically. The fixed part c(n) is innovative in its use of total excitation to model the difference between the periods, i.e. to correct the error between the adaptive excitation and the prediction residue.

As seen above, this excitation signal is optimized in the coder using the analysis by synthesis technique. Synthesis filtering of this excitation is therefore effected with the quantized filter to verify the result to be obtained in the decoder. This explains why it is possible to use locally-unstable long-term filtering, i.e. with a value of $g_p$ greater than 1, to model the attack of a signal because the increase in the energy caused by this instability is under control. Moreover, this control is disturbed by any frame losses.

In the decoder, if a frame is lost, or if an incorrect frame is received, the error dissimilation algorithm uses an excitation signal estimated from the past excitation signal. Typically only long-term prediction (LTP) filtering is used, retaining the last corrected decoded pitch value $g_{p_FEC}$. A disturbance is therefore injected into the excitation signal $x_d(n)$ of the decoder. For the subsequent valid frames, even if it is possible to decode correctly all the parameters $g_p$, P, $g_c$ and c(n) for generating the excitation signal, the excitation signal obtained is not exact because the past excitation signal $x_d(n-P)$ has been disturbed. The error injected during the lost frame can therefore propagate afterwards over many frames because of the recursive nature of the long-term filtering in voiced periods, in particular when $g_p$ is close to 1. In contrast, when $g_p$ has a low value or is equal to 0 in a number of non-voiced areas, the effect of the disturbance is attenuated or cancelled out because the weight of the innovator code c(n) is greater than its weight in the past.

It is therefore essential to be able to estimate the magnitude of the cumulative error in the adaptive part caused by transmission errors. To this end it is proposed to modify the decoder shown in FIG. 1(*c*) according to FIG. 3.

Figure 3:
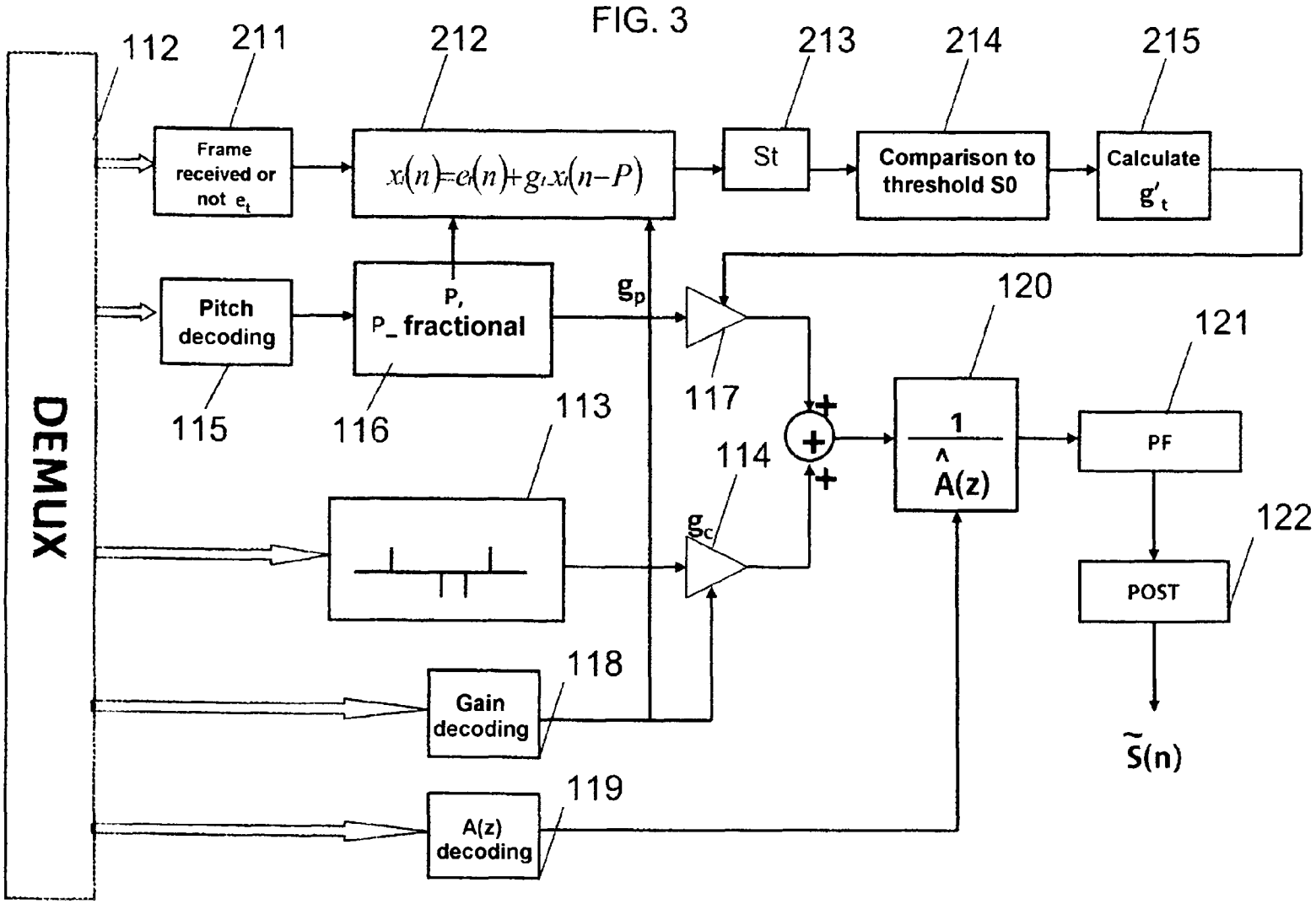
FIG. 3 is a diagram of a decoder of the invention.

FIG. 3 shows that, in parallel with long-term prediction (LTP) filtering, the decoder includes a line consisting of the blocks 211 to 215 for processing the excitation signal coming from the demultiplexer 112. This processing line of the decoder is also described to illustrate the principal steps of the method of the invention of limiting the adaptive excitation gain.

The block 211 is for detecting if a frame has been received correctly or not. This detection block is followed by a module 212 which effects an operation analogous to long-term LTP filtering. To be more precise, the module 212 calculates an error indication function $x_t(n)$ the values of which are representative of the cumulative decoding error over the adaptive excitation following a transmission loss. In this embodiment, this function is given by the equation:

$$x_t(n)=g_t x_t(n-p)+e_t(n)$$

in which $e_t(n)$ is equal to:

1 for frames not received or erroneous frames, in order to model the error injected into the adaptive loop;

0 for valid frames, when the error is propagated only because of the recursive nature of the long-term filter.

$g_t$ is equal to:

$g_{p_FEC}$, the value of the pitch gain of the preceding frame for frames not received;

$g_p$ for valid frames.

A module 213 then calculates from the values of the function $x_t(n)$ supplied by the module 212 an error indicator parameter $S_t$. For a valid frame, a comparator 214 verifies if the parameter $S_t$ has exceeded a certain threshold $S_0$. If the threshold has been exceeded and if the decoded pitch gain $g_p$ is greater than 1, the value of $g_p$ is limited, because in this situation there is a risk of saturating the LTP filter.

The error indication parameter $S_t$ can be the sum of the values of the function $x_t(n)$ or the maximum value, the average value or the sum of the squares of those values.

The comparator 214 is followed by a discriminator 215 adapted to determine the value $g'_t$ of the pitch gain to apply to the block 117 for the current frame, namely the decoded pitch value $g_p$ or a limited value.

If the parameter $S_t$ exceeds the threshold $S_0$ and if the decoded pitch gain $g_p$ is greater than 1, the gain $g'_t$ can be systematically limited to 1, for example, regardless of the magnitude of the overshoot. However, more progressive limitation can also be provided, consisting in defining the gain $g'_t$ as a linear function of the parameter $S_t$ of the form:

$$g'_t=g_p+(g_p-1)(S_0-S_t)/S$$

where S is an arbitrary coefficient for adjusting the slope of the variation of $g'_t$ with $S_t$.

It is equally possible to limit the gain relative to two successive thresholds, with a linear limitation between the two thresholds and a limitation to 1 beyond the second threshold, as shown by the following example.

To give a practical example, the LTP parameters P and $g_p$ for a valid frame are transmitted for each 5 ms sub-frame containing 40 samples. The processing to avoid saturation of the filter LTP, which is the subject matter of the invention, is also carried out at the sub-frame timing rate. The error indicator parameter $S_t$, for example the sum of the function $x_t(n)$, is calculated for each sub-frame. The value of this parameter is limited to 120, which corresponds to an average value of 3:

$$St = \min\left(\sum_{i=0}^{39} xt(n),\ 120\right)$$

If the pitch gain of the current sub-frame is greater than 1 and the value of $S_t$ is greater than a threshold of 80, corresponding to an average value of the samples $x_t(n)$ greater than 2, which shows that the cumulative error is high, the pitch gain value is decreased according to the following equation:

$$g'_t=1+(g_t-1)\cdot(120-S_t)/40$$

For the maximum value of $S_t$ ($S_t$=120), the new pitch gain is $g'_t$=1 and for the other values of $S_t$ ($80<S_t<120$), $1>g'_t>g_t$.

When the value of the pitch gain is modified as described above, the memory for the signal $x_t(n)$ is updated with a new value $g'_t$.

In contrast, if the pitch gain of the current sub-frame is less than 1 or the value of $S_t$ is less than 80, corresponding to a cumulative error in the synthesis filter that is low in the long term, the value of the decoded pitch gain is not modified and $g'_t=g_t$.

Finally, $g'_t$ is used instead of the decoded pitch gain to generate the excitation signal of the synthesis filter:

$$x_d(n)=g'_t x_d(n-P)+g_c(n)\cdot c(n)$$

In the embodiment described here, the long-term filter of the coder is a first order filter. However, if the coder uses a long-term LTP filter of higher order N, as for the G.723.1 coder, for example, the LTP pseudo-filter used to define the error indication function can be the equivalent first order filter or, more advantageously, a filter identical to that used in the coder, in particular of the same order. The first order equivalent filter is always used to identify during valid frames unstable areas in which it is necessary to limit the gain in the event of a high cumulative error and to determine the necessary attenuation.

If the parameter $S_t$ exceeds the threshold $S_0$ and if the equivalent gain $g_e$ is greater than 1, the gain $g'_t$ can be calculated in the same way as for a first order filter. The corrective factor $g'_t/g_e$ is then applied to the gains $g_i$ of the higher order filter.

The invention claimed is:

1. A method of limiting adaptive excitation gain in a decoder of an audio signal coded by a coder including a long-term prediction filter, following transmission frame loss between said coder and said decoder, characterized in that said method comprises, in the decoder, the steps consisting in:

establishing an error indication function intended to supply values representative of the accumulated error to adaptive excitation decoding after said transmission frame loss, an arbitrary value being assigned to said adaptive excitation gain for the lost frame;

calculating values of said error indication function during decoding;

calculating an error indication parameter from said values of the error indication function;

comparing said error indication parameter to at least one given threshold; and applying a limitation to at least one adaptive excitation gain in the event of positive comparison if a gain equivalent to at least one adaptive excitation gain is higher than a given value.

2. A method according to claim 1, wherein said equivalent gain is the adaptive excitation gain $g_p$ of a first order long-term predictive filter.

3. A method according to claim 1, wherein said equivalent gain is the equivalent gain $g_e$ of a long-term predictive filter of order greater than 1.

4. A method according to claim 1, wherein said arbitrary value is equal to a value of the adaptive excitation gain determined during said lost frame by an error dissimulation algorithm.

5. A method according to claim 1, wherein said error indication function is of the form:

$$x_t(n) = e_t(n) + \sum_i g_{it} \cdot x_t(n - P + i) \quad i \in [-(N-1)/2, (N-1)/2]$$

where:

N is the order of the long-term prediction filter;

the gains $g_{it}$ are equal to the adaptive excitation gains of said adaptive long-term filter for frames received or to the adaptive excitation gains of said long-term prediction filter in the preceding frame for frames lost;

$e_t(n)$ has the value 0 for received frames and the value 1 for lost frames;

P is the adaptive excitation period.

6. A method according to claim 1, wherein said error indication parameter represents the energy of said error indication function.

7. A method according to claim 6, wherein said representative parameter is obtained from the sum of the values of the error indication function.

8. A method according to claim 1, wherein the adaptive excitation gain $g_p$ of a first order long-term predictive filter is limited to the value 1 if said error indication parameter is above said given threshold.

9. A method according to claim 1, wherein a correction factor is applied to the adaptive excitation gains $g_i$ of a long-term predictive filter of order higher than 1 if said error indication parameter is above said given threshold.

10. A method according to claim 1, wherein said at least one adaptive excitation gain is limited by a linear function of said given threshold if said error indication parameter is above said threshold.

11. A method according to claim 1, wherein said adaptive excitation gain is supplied to said decoder by a coder equipped with a gain limiter device.

12. A program including instructions stored on a non-transitory computer-readable medium for executing the steps of the method according to claim 1 when said program is executed in a computer.

13. A decoder for an audio signal coded by a coder including a long-term prediction filter, wherein the decoder comprises:

a block (211) for detecting transmission frame losses;

a module (222) for calculating values of an error indication function representative of the cumulative adaptive excitation error during decoding following said transmission frame loss, an arbitrary value being assigned to said adaptive excitation gain for the lost frame;

a module (213) for calculating an error indication parameter from said values of the error indication function;

a comparator (214) for comparing said error indication parameter to at least one given threshold; and a discriminator (215) adapted to determine as a function of the results supplied by the comparator (214) a value of at least one adaptive excitation gain to be used by the decoder.

* * * * *